US005497843A

United States Patent [19]

Burns et al.

[11] Patent Number: 5,497,843

[45] Date of Patent: Mar. 12, 1996

[54] HOLLOW AUGER HEAD ASSEMBLY

[75] Inventors: Raymond W. Burns, Bethalto, Ill.; Kyle Oberlander, Florissant, Mo.

[73] Assignee: Central Mine Equipment, Earth City, Mo.

[21] Appl. No.: 410,497

[22] Filed: Mar. 24, 1995

[51] Int. Cl.$^6$ ..... E21B 10/62; E21B 10/46; E21B 10/48

[52] U.S. Cl. ..... 175/403; 175/413; 175/428; 175/430

[58] Field of Search ..... 175/402, 403, 175/404, 405, 405.1, 428, 432, 332, 336, 430, 431, 412, 413

[56] References Cited

U.S. PATENT DOCUMENTS

| | | | |
|---|---|---|---|
| 1,271,396 | 7/1918 | Walker | 175/403 X |
| 1,512,841 | 10/1924 | Gamble | 175/403 X |
| 1,765,296 | 6/1930 | Berry | 175/403 X |
| 1,774,084 | 8/1930 | Cooney | 175/403 X |
| 1,846,177 | 2/1932 | Bascom et al. | 175/403 X |
| 1,880,215 | 10/1932 | Simmons | 175/332 X |
| 2,080,116 | 5/1937 | Dean | 175/332 |
| 2,769,614 | 11/1956 | Zeni | 175/336 X |
| 3,830,321 | 8/1974 | McKenry et al. | 175/332 |
| 4,667,754 | 5/1987 | Diedrich | 175/403 X |

*Primary Examiner*—Stephen J. Novosad
*Attorney, Agent, or Firm*—Polster, Lieder, Woodruff & Lucchesi

[57] ABSTRACT

In a hollow earth auger head assembly a plurality of bit-holding pockets are provided, spaced circumferentially from one another around an open mouth of an auger head, and bits taken selectively from a multiplicity of types of cutting teeth, have a shank portion that seats in any and all of the pockets. A retaining pin extends chordally, off set from a diameter, through holes in the pocket and into a retaining pin receiver in the bits. In those bits that are intended to rotate in the pocket, the retaining receiver takes the form of an annular channel. In those bits that are not supposed to rotate, the retaining pin extends through a linear passage in or along a flat on the bit shank. In certain embodiments of sockets a chordal plug or weldment defines a space with one flat side against which a tail of the shanks of certain bits designed not to rotate bear.

5 Claims, 3 Drawing Sheets

HOLLOW AUGER HEAD ASSEMBLY

BACKGROUND OF THE INVENTION

It has been common heretofore to seat or chuck tools with similar shanks but different heads in the same holder in machine tools and numerous other applications. It has been unknown heretofore in the hollow auger earth drilling art 16 seat bits with teeth of different configurations and bits of different modes of operation alternatively in the same pockets. Pockets are conventionally welded or cast around the head of hollow earth augers. Heretofore, different pocket configurations have been employed for each different kind of bit or tooth, which has in effect required a different head for each type of bit and tooth.

One of the objects of this invention is to provide a hollow auger earth drill assembly wherein a multiplicity of types of bits can be seated in the same pockets.

Other objects will become apparent to those skilled in the art in the light of the following description and accompanying drawing.

SUMMARY OF THE INVENTION

In accordance with this invention, generally stated, a variety of bits, including those with fixed orientation and those intended to rotate within a pocket are made to be seated selectively, alternatively in one type of pocket.

The pocket preferably is symmetrical about a central axis. In the preferred embodiment, the pocket has a socket defined by a substantially circularly cylindrical inner side wall section, preferably with passages aligned chordally to receive a retainer in the form of a pin or nail, for example, and a radially outwardly tending side wall extending from the axially outer margin of the cylindrical section to an axially outer open mouth of the pocket. The pocket can have, within the axially inner end of the cylindrical section, a chordal plug, leaving an opening defined on one side by a flat surface of the plug and on the other by a semi-cylindrical surface of the inner wall of the socket.

Some bits that are to have a fixed orientation have a shank shaped complementarily to the pocket side walls, with a tail with a flat wall to fit against the flat wall of the socket plug, and a semi-cylindrical part that fits within the space defined by the plug and socket side wall. The cylindrical part of the shank above the tail has a chordal passage through it, aligned with the chordal passages in the cylindrical section of the socket to receive the retaining pin.

For a rotating bit, the pocket remains unchanged. The bit shank, however, has no tail section, the shank ending axially outwardly from the plug but axially inwardly from the chordal passages in the pocket. Instead of a chordal passage, the cylindrical part of the shank has an annular groove of a size slidably to receive the retainer that is inserted to extend through the pocket passages. This permits the shank to rotate.

If the socket and bit shank are made non-circular, they are only adapted to use as a fixedly oriented tool. In all of the embodiments, a protective sleeve or shield can be mounted on the pocket to protect it from abrasion.

IN THE DRAWINGS

DESCRIPTION OF THE PREFERRED EMBODIMENT

Figure 1:
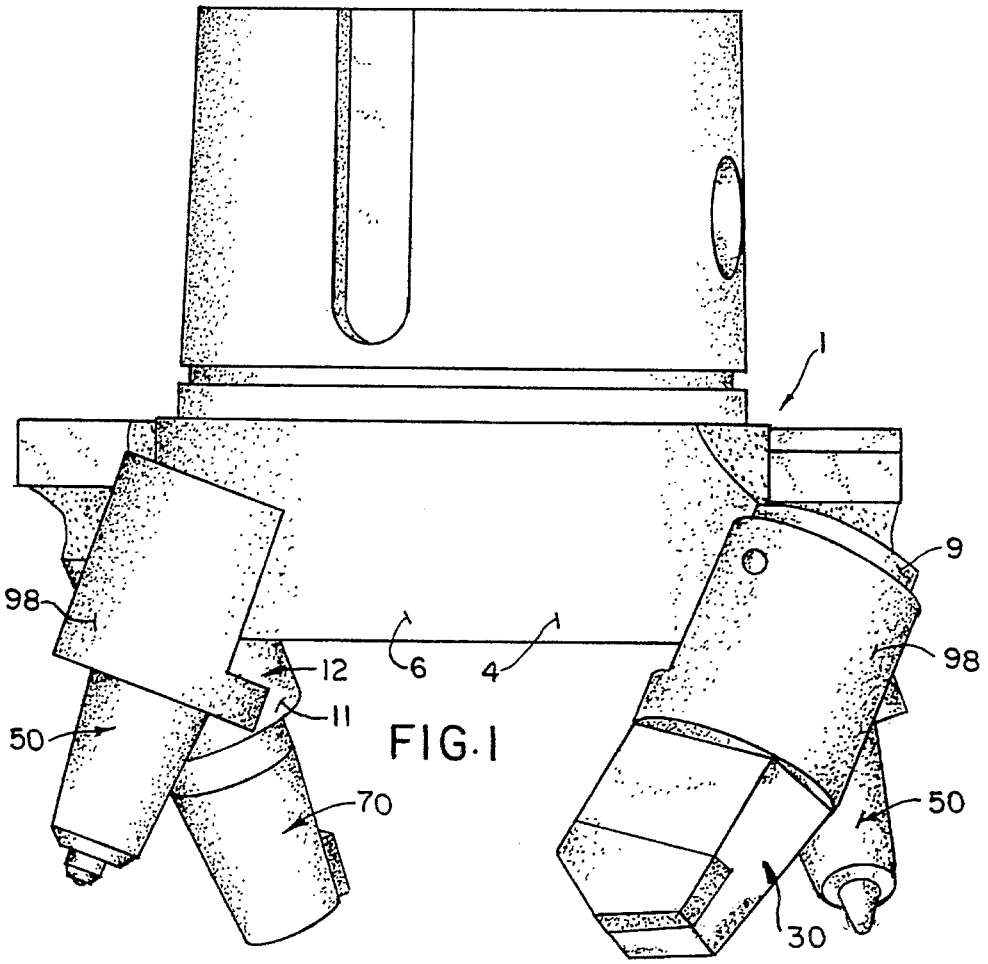
FIG. 1 is a view in side elevation of one embodiment of hollow earth auger head assembly of this invention, with various bits mounted for illustrative purposes.

Referring now to the drawing for an illustrative embodiment of the assembly of this invention, reference numeral 1 indicates an earth auger head assembly which includes a hollow auger head 4, pockets 9 and bits 30, 50, and 70.

The head 4 has a cylindrical side wall 5 with an outer surface 6 and an inner surface 7. The pockets 9, in this embodiment, are welded by weldments 10 between an outer surface 11 of a side wall 12 and the outer surface 6 of the head, around the head. They are spaced, circumferentially of the head, and are oriented at an angle to the center line of the auger. A socket 13 within each pocket 9 is defined by an inner surface 16 of the side wall 12. The socket 13 has a tapered section 19, diverging outwardly toward its open mouth, and a cylindrical section 20 at the axially inner end of the tapered section 19. A flat bearing surface 17 extends between the outer surface 11 and the inner surface 16 at the open lower end of the socket. Retainer passages 23 are aligned chordally, off-set from a diameter, through the side wall 12.

In this embodiment, a semicircular plug or weldment 27 is formed or welded in the axially inner or upper end of the socket 13, leaving a passage 28 defined by a flat face 29 of the plug and a part of the cylindrical section 20 of the inner surface 16 of the side wall 12.

Figure 2:
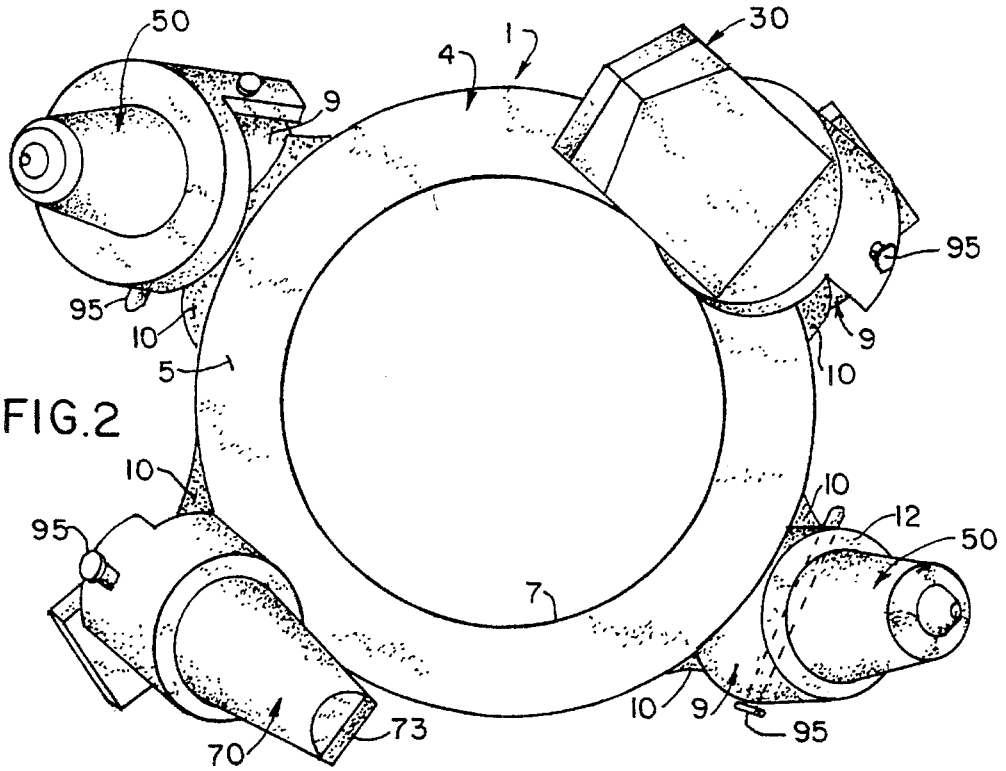
FIG. 2 is a bottom plan view of the assembly shown in FIG. 1.
Figure 3A:
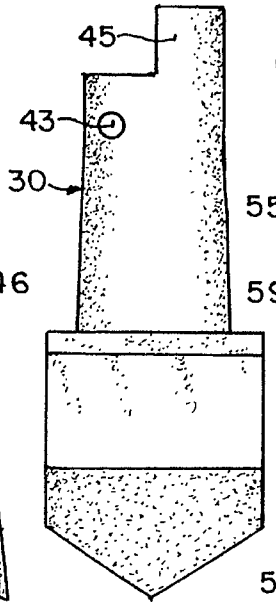
FIG. 3A is a view in front elevation of the bit shown in FIG. 3.
Figure 3:
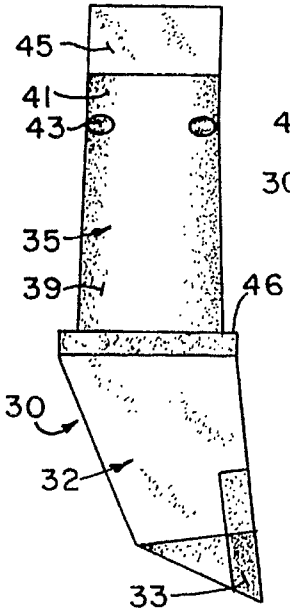
FIG. 3 is a view in side elevation of one of the bits.

In one embodiment of bit, 30, shown in FIGS. 1, 2, 3 and 3A, the bit 30 has a tooth part 32, and a shank part 35. The tooth part 32 is provided with a carbide or other hard material insert 33, which is conventional. The shank part 35 has a tapered section 39 shaped and sized complementarily to the tapered section 19 of the socket 13, and a cylindrical section 41, shaped and sized complementarily to the cylindrical section 20 of the socket. A chordal passage 43 through the cylindrical portion of the shank is of a radial size with, and aligned with the passages 23 through the pocket wall 12. As shown in FIGS. 3 and 3A, the axially inner or upper end of the cylindrical section 41 has a tail 45, shaped to fit closely but slidably in the passage 28 of the socket. The tapered section of the shank meets the tooth at a shoulder 46, which bears against the surface 17 of the pocket.

In all of the embodiments, a retaining pin 95 extends through the passages 23 and through retaining means in the shanks of the bits. In the bit 30, the retaining means is the retainer passage 43.

Figure 4:
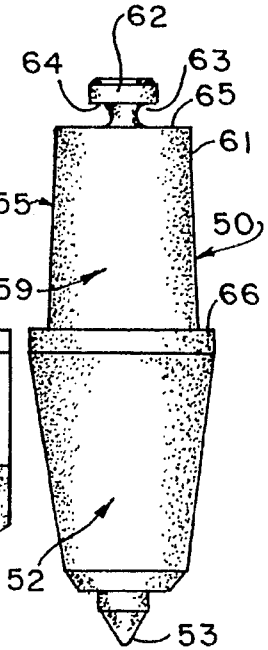
FIG. 4 is a view in side elevation of a different form of bit.

A second embodiment of bit, 50, is shown in FIGS. 1, 2 and 4. The bit 50 is designed to rotate in the socket 9. It has a conventional tooth section 52, with an insert of carbide or the like. The bit 50 has a shank 55, which, like the shank 35 of the bit 30 has an axially downwardly diverging tapered section 59, and a cylindrical section 61. In this embodiment, the cylindrical section 61 is reduced in diameter at its axially innermost or upper end, and is provided with an annular channel 63, defined by an axially upper, radially extending wall surface 64 and an axially lower, radially extending wall surface 65. The two surfaces are curved at their radially inner edges and meet to form a bottom surface of the channel. As was the case with the bit 30, the shank 55, which is circular in cross section, meets the tooth at a shoulder 66. As can be seen from the drawing, and appreciated from the position of the retainer passage 63 (the annular channel of the bit 50), the entire shank 55 is shorter than the shank 35 of the bit 30. It is, in fact, short enough that the reduced end 62 of the cylindrical section 61 is axially clear of the lower surface of the plug 27. This permits the bit 50 to rotate in the socket 13.

A third illustrative type of bit, 70, is illustrated in FIGS. 1, 2, 5 and 6. In this embodiment, a tooth 72 of the bit has an insert tip 73 which differs from the insert 33 in having a straight axially outer edge, and more of a rake than the insert 33. The bit 70 has a shank 75, with a tapered section 79 and a cylindrical section 80, and a retainer pin passage 83, all corresponding to the same parts of the bit 30. However, the bit 70 does not have a tail section, depending upon the presence of a retaining pin 95 to prevent its rotation. In each embodiment, the retaining pin 95, extending through the passages 23, either passes through the linear passage in the shank or, in the case of the bit 50, through the passage formed by the channel 63, tangent to the bottom of the channel. The pin 95, which can be a steel pin or even a common nail, serves in the embodiments shown to keep the bit from falling out of the socket, the axial thrust of the bit in use being borne by the shoulder between the shank and the tooth and the bearing surface, of the pocket. In the embodiment shown in FIGS. 5 and 6, the retaining pin resists any tendency of the bit to rotate, but the construction of the tooth is such as not to place any great strain on the pin in that respect.

In the illustrations of FIGS. 1 and 2, a protective sleeve or socket shield 98, which is described in detail in Applicant's co-pending application, Ser. No. 280063/08, now U.S. Pat. No. 5,460,232, is mounted on and around the radially outer part of the pocket. The retaining pin 95 extends through holes in the side wall of the shield 98 that are aligned with the holes 23 in the pocket wall, holding the entire assemblage together.

Figure 9:
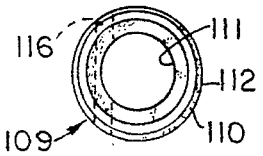
FIG. 9 is a top plan view of another embodiment of pocket.
Figure 11:
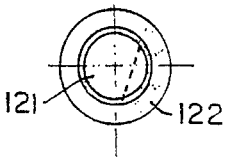
FIG. 11 is a top plan view of another embodiment of bit.
Figure 13:
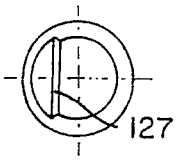
FIG. 13 is a bottom plan view of the bit shown in FIGS. 11 and 12.
Figure 10:
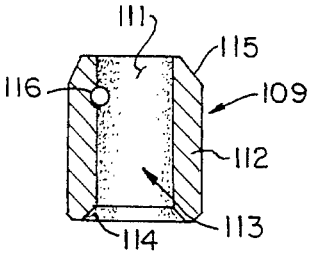
FIG. 10 is a diametric sectional view of the pocket shown in FIG. 9.
Figure 12:
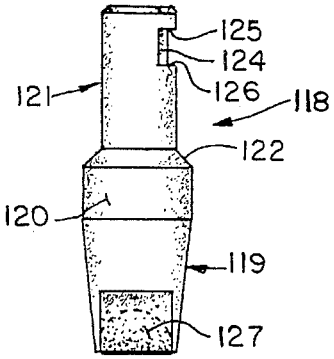
FIG. 12 is a view in front elevation of the bit shown in FIG. 11.
Figure 14:
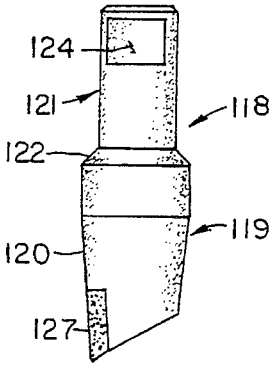
FIG. 14 is a view in side elevation of the bit of FIG. 12.

Referring now to FIGS. 9 and 10, a pocket 109 is shown before it is welded to a head of an auger. In the pocket 109, side wall 112 with an inner cylindrical surface 111 and an outer cylindrical surface 110 defines a socket 113. In this embodiment, the socket 113 is substantially straight sided as compared with that part of the inner surface of the socket 13 that tapers convergently upwardly. The pocket 109 has a retainer passage 116 which differs from the retainer passage 23 of the first embodiment only in being farther from the center of the socket 113, being partly formed throughout the side wall, as shown in FIGS. 9 and 10, so that a retaining pin is given additional support, and extends less far into the socket 113 than the retaining pin 95 of the first embodiment. The socket 113 has at its lower end an internal chamfer 114. At its upper end, the pocket 109 has an exterior chamfer 115.

In FIGS. 11 through 14, another embodiment of bit, peculiarly adapted to use with a socket of the type shown in FIGS. 9 and 10 is illustrated. The bit 118 has a tooth 119, as part of a head 120, a shank 121 and, between the shank and the head, a sloping shoulder 122, of a slope complementary to the chamfer 114 of the socket 113. The shank 121 has, in lieu of a passage 83, a flat 124 bounded at its upper end by a ledge or shelf 125 and at its lower end by a shelf or ledge 126. The tooth 119 is provided with a carbide insert 127. The shoulder 122 rests on the chamfered part 114 of the pocket, providing more bearing surface than the shoulder 46, 66, or 86 of the bits shown in FIGS. 3 through 6.

Figure 7:
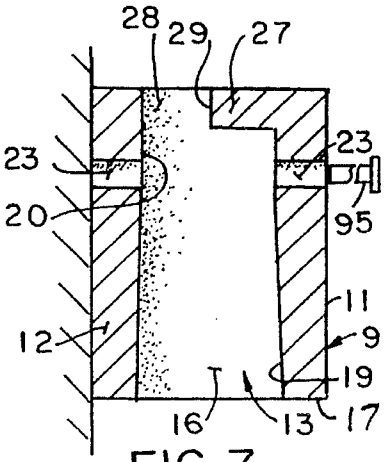
FIG. 7 is a sectional view through a pocket shown in FIGS. 1 and 2.
Figure 8:
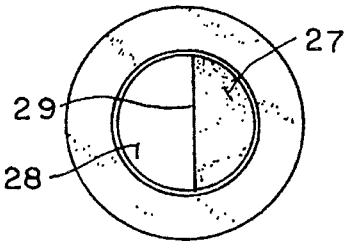
FIG. 8 is a top plan view of the pocket shown in FIG. 7.
Figure 6:
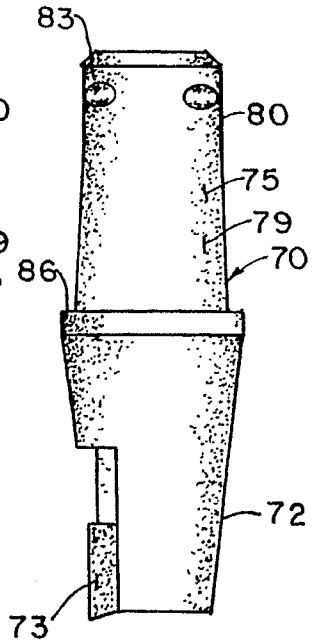
FIG. 6 is a view in side elevation of the bit shown in FIG. 5.
Figure 5:
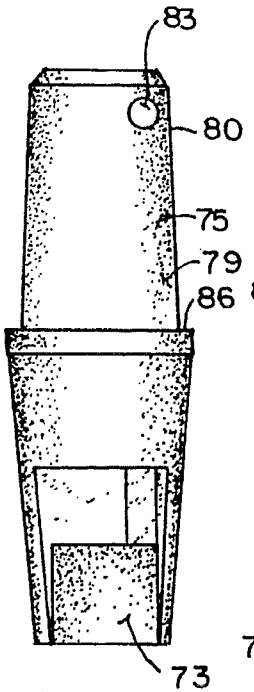
FIG. 5 is a view in front elevation of yet another style of bit.
Figure 15:
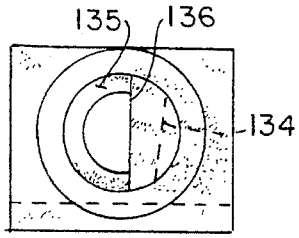
FIG. 15 is a top plan view of another embodiment of bit.
Figure 16:
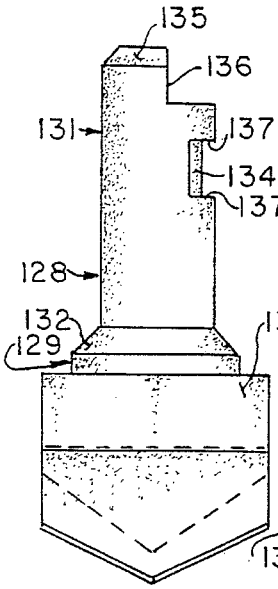
FIG. 16 is a view in front elevation of the bit shown in FIG. 15.
Figure 17:
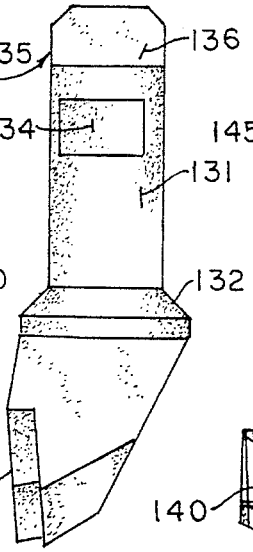
FIG. 17 is a view in side elevation of the bit of FIG. 16.

In FIGS. 15 through 17, another embodiment of bit is shown. This bit 128 has a tooth 129 forming a part of a head 130, a shank 131, and between the shank and the head, a sloping shoulder 132, also complementarily in slope to a chamfer on a socket into which the shank extends. The bit 128 is shown as having a carbide insert 133. The shank 131 in this embodiment has a tail 135 with a diametric flat surface 136. It is designed to fit into a socket having the configuration of the socket 113 of the pocket 109, but the pocket into which the bit 128 is to be mounted will have a plug or weldment of the type shown in the pocket of FIG. 7. Like the bit 118, the bit 128 has in the shank 131 a flat 134, bounded by upper and lower ledges 137.

Figure 18:
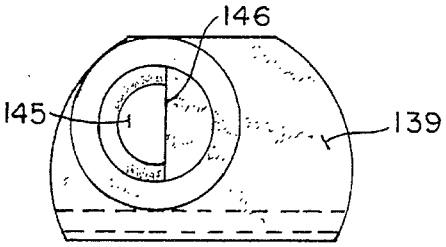
FIG. 18 is a top plan view of still another embodiment of bit.
Figure 19:
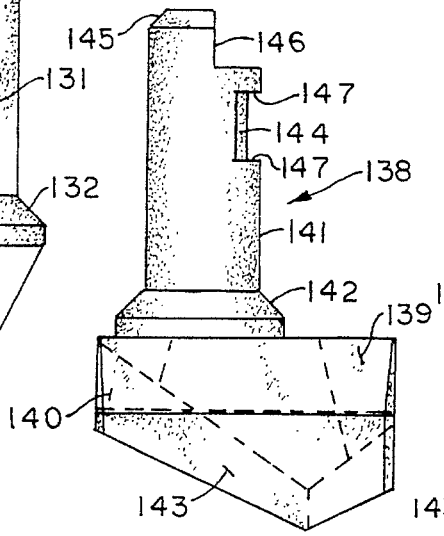
FIG. 19 is a view in front elevation of the bit of FIG. 18.
Figure 20:
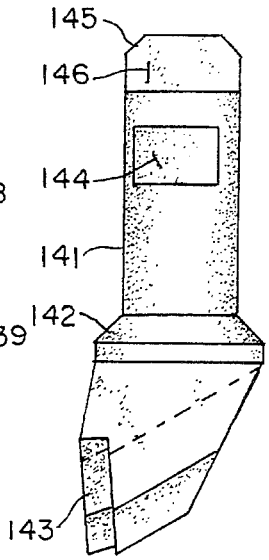
FIG. 20 is a view in side elevation of the bit of FIG. 19.

Referring to FIGS. 18 through 20, still another embodiment of bit is shown. This bit 138 also has a tooth 139 as part of a head 140, a shank 141, and a sloping shoulder 142 between the shank and the body. The tooth has an insert 143. The shank has a tail 145 with a diametric flat surface 146, and a flat 144 bounded by upper and lower ledges 147. The mounting of the bit 138 is the same as that of the bit 128.

It will be observed that in all of the embodiments, the angle of the flat in the embodiment shown in FIGS. 11 through 20 and the angle of the passage in the embodiment shown in FIGS. 1 through 8 is a few degrees, as for example, 8 degrees, off a line perpendicular to the flat face of the insert or seat in which the insert is mounted. This has been found to minimize the likelihood of abrasion of the retaining pin. However, such abrasion has not been found to be a problem; the bits generally seat securely during and after use. Accordingly, the passages or flats can, have any other desired relative angularity.

When the shank of the bit is provided with a retainer-receiving flat, the upper ledge or shelf is the element that retains the bit in the socket, in cooperation with the retainer pin.

Numerous variations in the construction of the assembly of this invention will occur to those skilled in the art in the light of the foregoing disclosure. Merely by way of illustration, the shank can be tapered from its juncture with the tooth to its axially inner end. The bits with a tapered section can be provided with a chamfered shoulder, and the sockets to accommodate them can be provided with a chamfered bearing surface. Similarly, the straight cylindrically shanked bits can be provided with a flat bearing shoulder, although the chamfered shoulder and pocket bearing surface have been found to have certain advantages. Straight cylindrically shanked bits can be grooved annularly to permit their rotation. In the non-rotating types of bits, the passage can be defined by a channel with a linear bottom surface, machined into one side of the shank. Other retaining means besides a pin can be employed, such as a set screw In a non-rotating type of bit, the socket can be polygonal, and the shank complementarily shaped. However, such a construction is not as versatile as the shapes illustrated, because it precludes the use of a rotating bit in the same socket. These are merely illustrative. The essential part of the construction is that the sockets and the bit shanks are so constructed that they are compatible, no matter what the configuration of the tooth, and whether the retainer receiving means is linear or annular.

We claim:

1. In a hollow earth auger head assembly the improvement comprising a plurality of bit pockets spaced circumferentially from one another around an open mouth of an auger head, said open mouth being defined by an outer edge of a cylindrical side wall, said pockets being arranged around an outer surface of said side wall, each of said pockets having a socket opening toward said outer edge of said cylindrical wall, and bits adapted to be seated in said sockets, said bits having a multiplicity of types of cutting teeth but all of said bits having a shank portion that seats in any of said pocket sockets, each of said pockets having a side wall defining said socket, and passages chordally aligned with one another and chordally offset from the diametric, extending through said side wall to receive pin means for retaining said bits, said bits having complementary pin means retaining means in said shank portion.

2. The improvement of claim 1 wherein said pin means receiving means in bits designed to rotate in said pocket sockets comprise an annular channel, defining walls of which extend above and below said pin means.

3. The improvement of claim 1 wherein in bits designed not to rotate, said pin means receiving means comprise a linear passage through said shank aligned with said pocket chordal passages.

4. The improvement of claim 3 wherein said pocket has a chordal plug at an axially inner end, and said bits have at an end of the shank opposite their tooth, a tail projecting into a space defined by a surface of said chordal plug and an inside wall of said socket.

5. The improvement of claim 1 wherein in bits designed not to rotate, said pin means receiving means comprise a flat formed on said shank, defined in part by a ledge projecting radially at an upper end of said shank.

* * * * *